US009849062B2

(12) United States Patent
Juto

(10) Patent No.: US 9,849,062 B2
(45) Date of Patent: Dec. 26, 2017

(54) VIBRATION DEVICE

(75) Inventor: Jan-Erik Juto, Stockholm (SE)

(73) Assignee: CHORDATE MEDICAL AB, Stockholm (SE)

( * ) Notice: Subject to any disclaimer, the term of this patent is extended or adjusted under 35 U.S.C. 154(b) by 1785 days.

(21) Appl. No.: 12/600,195

(22) PCT Filed: May 16, 2008

(86) PCT No.: PCT/EP2008/056080

§ 371 (c)(1),
(2), (4) Date: Dec. 10, 2009

(87) PCT Pub. No.: WO2008/138997

PCT Pub. Date: Nov. 20, 2008

(65) Prior Publication Data

US 2010/0274164 A1 Oct. 28, 2010

(30) Foreign Application Priority Data

May 16, 2007 (SE) ..... 0701222-2

(51) Int. Cl.

| | |
|---|---|
| ***A61H 21/00*** | (2006.01) |
| ***A61H 9/00*** | (2006.01) |
| ***A61H 23/02*** | (2006.01) |

(52) U.S. Cl.

CPC ..... *A61H 21/00* (2013.01); *A61H 9/0078* (2013.01); *A61H 23/0236* (2013.01); *A61H 2201/0103* (2013.01); *A61H 2201/105* (2013.01)

(58) Field of Classification Search

CPC ..... A61H 9/00; A61H 9/0007; A61H 9/005; A61H 9/0078; A61H 21/00; A61H 23/00;
(Continued)

(56) References Cited

U.S. PATENT DOCUMENTS

| | | | |
|---|---|---|---|
| 901,376 | A | 10/1908 | Roberts |
| 912,205 | A | 2/1909 | Talcott |

(Continued)

FOREIGN PATENT DOCUMENTS

| | | |
|---|---|---|
| CH | 329193 | 4/1958 |
| EP | 0 825 889 A2 | 3/1998 |

(Continued)

OTHER PUBLICATIONS

AersollnhalatorAl-1; "Aerosol Inhalator Al-1, Manual"; 1979, XP55301490, Retrieved from the Internet: URL; http://ladoved.narodsu/medtehnika_PDF/47.Al-1.pdf, pp. 1-9.

*Primary Examiner* — Michael Tsai

(74) *Attorney, Agent, or Firm* — Birch, Stewart, Kolasch & Birch, LLP

(57) ABSTRACT

A device is provided for vibrational stimulation of body tissue in body cavities which are difficult to access, particularly in the nasal cavity. The device includes an expandable stimulation member, which can be introduced via a body opening into a body cavity. In an expanded state of the device, the stimulation means abuts against the body tissue within the body cavity. To accomplish vibrational stimulation, the stimulation member is brought to vibrate at a frequency of 48-70 Hz within the body cavity. A method is also provided for vibrational stimulation of body tissue in a body cavity, particularly in the nasal cavity of a patient.

36 Claims, 9 Drawing Sheets

(58) Field of Classification Search

CPC ..... A61H 23/04; A61H 2201/0103; A61H 2201/1238; A61H 2201/1246; A61H 2205/023; A61F 7/12; A61F 7/123; A61F 2007/0054; A61F 2007/0055; A61F 2007/0056; A61F 2007/0057; A61M 29/00; A61M 29/02

USPC ..... 601/46, 55–59, 61, 148, 149, 150; 606/191; 604/22

See application file for complete search history.

(56) References Cited

U.S. PATENT DOCUMENTS

| | | | | |
|---|---|---|---|---|
| 961,034 | A | 6/1910 | Siebert et al. | |
| 1,735,519 | A * | 11/1929 | Vance | 606/196 |
| 1,764,838 | A | 6/1930 | Home | |
| 2,052,321 | A * | 8/1936 | Smart | 604/94.01 |
| 2,101,273 | A * | 12/1937 | Smith | 601/18 |
| 3,848,607 | A * | 11/1974 | St. Clair | 607/105 |
| 3,903,893 | A * | 9/1975 | Scheer | 606/196 |
| 4,911,149 | A * | 3/1990 | Borodulin et al. | 601/46 |
| 5,609,606 | A * | 3/1997 | O'Boyle | 606/194 |
| 6,159,170 | A | 12/2000 | Borodulin et al. | |
| 6,193,680 | B1 | 2/2001 | Parsons et al. | |
| 7,108,706 | B2 * | 9/2006 | Hogle | 606/199 |
| 8,317,816 | B2 * | 11/2012 | Becker | 606/196 |
| 2002/0072781 | A1 | 6/2002 | Lattner et al. | |
| 2002/0177889 | A1 | 11/2002 | Brisken et al. | |
| 2003/0087734 | A1 * | 5/2003 | Kring et al. | 482/112 |
| 2004/0172112 | A1 | 9/2004 | Cioanta et al. | |
| 2008/0200848 | A1 * | 8/2008 | Avni | 601/46 |

FOREIGN PATENT DOCUMENTS

| | | | |
|---|---|---|---|
| EP | 0 935 980 | A1 | 8/1999 |
| EP | 1 626 766 | A2 | 2/2006 |
| FR | 592 104 | | 7/1925 |
| FR | 920 885 | | 4/1947 |
| GB | 1 217 760 | | 12/1970 |
| IL | WO2006/129305 | * | 12/2006 |
| JP | 2001-17500 | A | 1/2001 |
| JP | 2001-37883 | A | 2/2001 |
| RU | 2 099 039 | C1 | 3/1992 |
| RU | 2 199 303 | C1 | 6/2001 |
| SU | 1148614 | A | 4/1985 |
| SU | 1 560 205 | A1 | 4/1990 |
| WO | WO 96/36396 | A2 | 11/1996 |
| WO | WO 96/39218 | A1 | 12/1996 |
| WO | WO-01/41695 | A2 | 6/2001 |
| WO | WO 2004/105579 | A2 | 12/2004 |
| WO | WO 2008/138997 | A1 | 11/2008 |

* cited by examiner

VIBRATION DEVICE

TECHNICAL FIELD

The present invention relates to vibration devices and methods for vibrational stimulation of body tissue in body cavities, particularly in the nasal cavity or intestine.

TECHNICAL BACKGROUND

There are several known devices for conducting treatments in the body cavities of patients. Devices for use in the nasal cavity aim e.g. at decongesting the nasal mucosa and are often used together with some chemical substance. Various types of packings to stop bleeding in a body cavity, e.g. during surgery, are commonly used. Devices are also known which by mechanical vibration affect tissue in a body cavity, e.g. in the ear or over a body surface.

In US 2002/0072781A1 is shown and described e.g. various techniques for mechanical stimulation of vestibular nerves in the ear for the purpose of directly controlling respiratory system function. The stimulation can e.g. occur by an inflatable balloon exerting a static pressure on adjacent tissue. By varying the pressure, a certain sensation can be evoked. There is further shown and described another device for mechanical stimulation of nerves, which comprises a body that is vibrating at a certain frequency.

Devices for prevention of bleeding in the nasal cavity and other body cavities by means of an inflatable balloon are previously known. For instance, WO9639218 and EP1626766 disclose inflatable packages for use in connection to surgery for prevention of bleeding.

Other examples of devices for treatments in the nasal cavity are e.g. nasal dilators. These devices are intended to facilitate breathing by physically keeping passages in the nose open, which in certain respects are intended to reduce snoring.

Devices for treatment of rhinitis and other conditions in the nasal cavity by means of radiation with electromagnetic waves are disclosed in e.g. EP0935980 and EP0825889.

Swollen mucosa in the nasal cavity can be treated by means of various devices that are used in combination with chemical substances, such as e.g. ethanol. Conditions like inflammation in the nasal cavity are however usually treated with various pharmaceutical substances.

Patients suffering from chronic or non-chronic inflammatory conditions in body cavities, such as the nasal cavity, are often alleviated by treatment with corticosteroids, such as e.g. cortisone. Unfortunately, cortisone therapy has several side effects, especially in the case of long-term treatment. Known side effects are in general e.g. accumulation of fluid in the body, high blood pressure and metabolic changes. Rhinitis is a common side effect from treatment in the nasal cavity.

Patients suffering from chronic nasal congestion often develop a drug addiction, rhinitis medicamentosa, wherein the patient must be treated with nasal spray or nose drops once or several times per day in order to avoid nasal congestion. A satisfactory therapy form and devices for this is lacking.

SUMMARY OF THE INVENTION

An object of the invention is to provide a vibration device for stimulation of body tissue in body cavities which are difficult to access in a patient. Another object is to provide a method for stimulation over these tissue surfaces by means of vibration. These objects are achieved by a device and a method according to the appended claims.

According to one aspect of the invention, there is provided a vibration device for stimulation of body tissue in a body cavity, particularly in the nasal cavity or the intestine, of a patient, comprising:

- expandable stimulation means; and
- vibration means for bringing the stimulation means to vibrate;
- wherein the vibration device can be arranged in a first state wherein the stimulation means can be introduced via a body opening into a body cavity, and a second state wherein the stimulation means is expanded to a volume such that the stimulation means abuts against the tissue within the body cavity.

If the body cavity is hidden behind a tight body opening, which e.g. is the case in the nose, said stimulation means is, in a first state of the vibration device, introducible through the opening, e.g. the nostril. Accordingly, the stimulation means has a variable volume, which implies a variable size of the device and which simplifies introduction in a narrow cavity.

In order to provide a good contact surface with the body tissue in a nasal or body cavity which is difficult to access, the stimulation means has, in a second state of the device, a size such that considerable areas of tissue are affected simultaneously. The stimulation means abuts a tissue surface, wherein a good and tight contact is achieved between the stimulation means and surrounding body tissue.

The device according to the invention can suitably be used for treatment by vibrational stimulation, e.g. for normalizing a nerve function. The device enables access to large areas of tissue in body cavities which are difficult to access. The vibrational stimulation is achieved by said vibration means, which brings the stimulation means to vibrate. If the treatment affects the size of the nasal or body cavity, it may be necessary to change the volume of the stimulation means during the course of the treatment.

In those cases where the patient can see the device before it is introduced into the body cavity, it is also an advantage that it does not appear too frightening by its volume. A patient refers to a human or an animal. Both patients that are well and unwell can be treated by the device according to the invention. An example of a patient that is well is an athlete who desires to dilate the passage in his nose before a physical performance.

Said vibration means of the device according to the invention brings the stimulation means to vibrate at a frequency of preferably 1-5000 Hz, more preferably 10-100 Hz, more preferably 30-70 Hz, and most preferably 35-60 Hz. For treatment in the nasal cavity, the stimulation means is brought to vibrate at a frequency of preferably 30-70 Hz. Other frequency intervals apply for treatment of tissue surfaces in other body cavities.

The stimulation means preferably has a smooth outer surface and/or the outer surface of the stimulation means comprises a lubricant to facilitate passage through the body opening. The lubricant may e.g. be a paraffin solution or other lubricants that are well known to the skilled person.

In one embodiment of the invention, the vibration device comprises a stabilizing section, which provides shape and stability to the device. The shape of the device is to varying extent maintained even when it is not arranged in its second, expanded state. Accordingly, the stabilizing section can facilitate introduction and positioning of the device comprising stimulation means into the body opening and the body cavity, respectively.

In another embodiment of the invention, the vibration device comprises expansion means for expanding the stimulation means. The expansion means preferably comprises at least one channel for supplying fluid to the stimulation means, which achieves said expansion. The vibration means is preferably arranged so as to provide vibrations to said fluid.

In one instance, the stimulation means can in the first (i.e. essentially non-expanded) state of the device be contained in the expansion means. In connection to treatment, the stimulation means is brought out of the expansion means only after the device has been introduced into the body opening. The width of the vibration device can in this way be minimized, which facilitates introduction through a tight passage into the body cavity. The stimulation means can preferably be contained in a channel of the expansion means in the first state of the device.

In another instance, the stimulation means can in the first state of the device be arranged around the expansion means. During treatment, the device is introduced into a body cavity in this state, whereupon the stimulation means is transferred to the second state of the device when the stimulation means is in appropriate position within the body cavity. As in the case above, the width of the device can in this way be minimized, and introduction through a tight passage into the body cavity is thereby facilitated.

In another instance, the stimulation means can in the first state of the device be arranged around the stabilizing section.

In one embodiment of the invention, the vibration device comprises an exchangeable hygienic protective cover, arranged to enclose the stimulation means. It is thereby provided a device that can be used again without exposing tissues to bacterial hazard or other chemical or biological hazard. The hygienic protective cover encloses preferably the stimulation means and expands in volume like the stimulation means.

Another aspect of the invention provides a method for stimulation of body tissue in a body cavity, particularly in the nasal cavity or intestine, of a patient, comprising the steps of:

- providing a vibration device comprising expandable stimulation means, wherein the stimulation means can be introduced via a body opening into a body cavity;
- introducing the stimulation means via the body opening into the body cavity;
- expanding the stimulation means to a second state of the vibration device such that the stimulation means abuts against the tissue within the body cavity; and
- bringing the stimulation means to vibrate in said second state.

In one embodiment of the method according to the invention, the vibration device is prior to the introduction preferably arranged in a first state, wherein the stimulation means can be introduced via a body opening into a body cavity.

Devices and methods according to the invention can thus be used for stimulation of nerve endings and blood vessels over large areas of tissue in body cavities that are difficult to access, preferably nerve endings in mucosa in the nasal cavity, but also deeper blood vessels, by means of mechanical vibrations.

Devices and methods according to the invention can be used for treatment in air-conducting cavities, e.g. intestine and nose, and in liquid-conducting cavities, e.g. blood vessels, bile duct and ureter, of patients.

Treatment of e.g. nasal congestion associated with common cold by the method according to the invention achieves mucosal decongestion. The method gives the patient a subjective sense of relief from the nasal congestion. The effect remains for several hours and causes no rebound effect. Such rebound effect occurs with most so called nose drops and nasal sprays for common cold that are commercially available.

Vibrational stimulation of nerve endings and blood vessels in body cavities of a patient by the method according to the invention can affect several different conditions. In the case of vibrational stimulation of mucosa in the nasal cavity, the method affects e.g. patients with common cold, allergic rhinitis, chronic and non-chronic non-allergic rhinitis, rhinitis medicamentosa, and patients with a tight passage in the upper respiratory tract, by dilating the passage in the nasal cavity.

Vibrational stimulation of body tissue by the method according to the invention achieves e.g. improved sense of smell in patients with disturbed function of the sense of smell, decreased relapse following polyps treatment, decreased tissue inflammation, alleviation of obstacles in the upper respiratory tract in case of snoring, as well as decreased needs for medication with corticosteroids, such as cortisone, in case of inflammatory conditions.

Vibrational stimulation of nerve endings by the method according to the invention can promote a sensory nerve response, probably also a motory nerve response, and normalize nerve function in patients with aberrant sensory nerve function, e.g. neurological hyper- or hypoactivity.

Vibrational stimulation by the method according to the invention can for instance be used for treatment of tinnitus symptoms, asthma, chronic chorditis, intestinal inflammation, preferably in the colon, ulcerous colitis, Crohn's disease, and urethritis.

Vibrational stimulation of nerve endings by the method according to the invention can also alleviate neurogenic pain conditions. Alleviation of pain is achieved by the method according to the invention in case of neuralgia in the nose.

Vibrational stimulation of deeper blood vessels and veins can achieve vascular constriction and thereby decrease swelling in body tissue.

The device according to the invention can also be used for local administration of pharmaceuticals into blood vessels or into body openings. The device can for instance complement a conventional treatment with a medicament, e.g. cortisone.

Other embodiments of the above-indicated aspects of the invention are evident from the independent claims.

BRIEF DESCRIPTION OF THE DRAWINGS

In the following detailed description it is referred to the appended drawings, in which.

DETAILED DESCRIPTION OF PREFERRED EMBODIMENTS

Preferred embodiments of the present invention will now be described as non-limiting examples and with reference to the figures.

Figure 1:
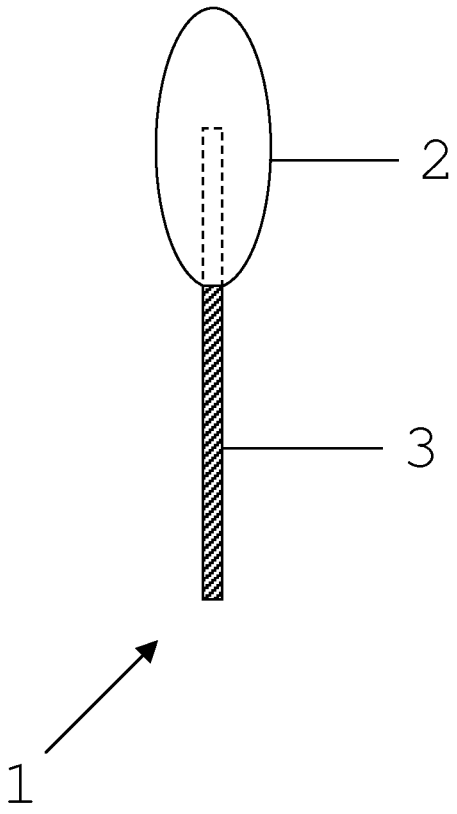
FIG. 1 schematically shows an embodiment of a vibration device according to the present invention.
Figure 2:
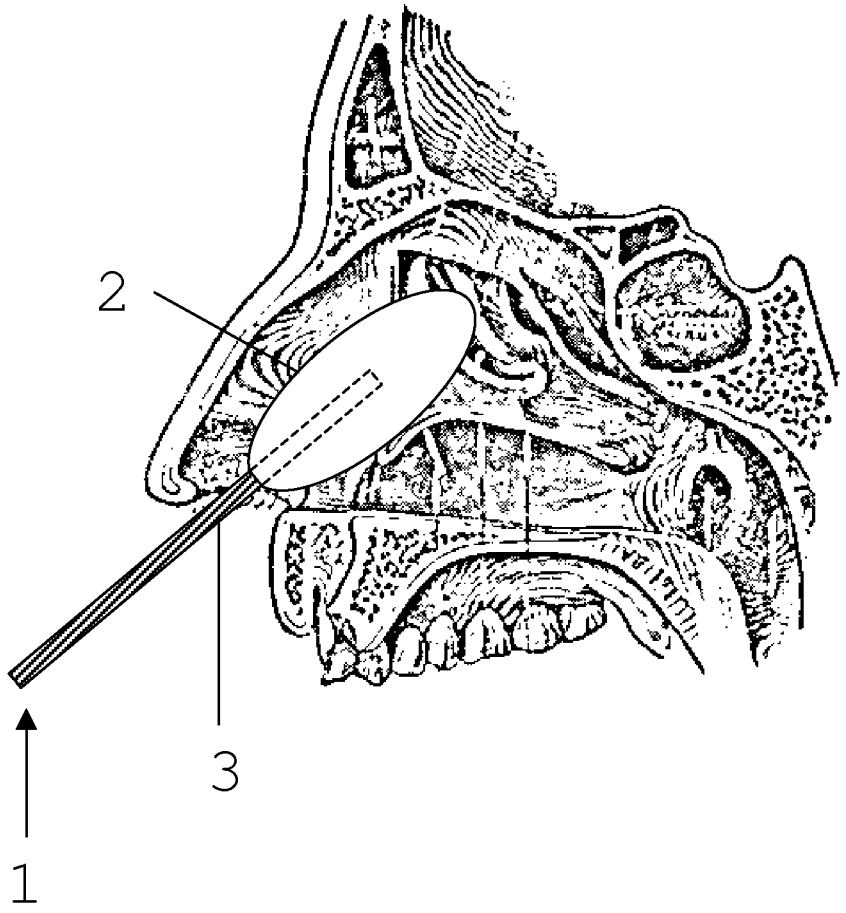
FIG. 2 schematically shows an embodiment of a vibration device according to the invention within the nasal cavity.

According to a first aspect of the invention, there is achieved a vibration device 1 for stimulation of nerve endings and blood vessels in body tissue in a body cavity (FIG. 1). The device comprises expandable stimulation means 2 and vibration means for bringing the stimulation means to vibrate. For introduction of the stimulation means via a body opening into a body cavity, e.g. the nasal cavity, the vibration device can be arranged in a first state, wherein the stimulation means can be introduced through the body opening, e.g. the nostril. The vibration device 1 can also be arranged in a second state, wherein the stimulation means 2 is expanded to a volume such that the stimulation means is brought into close contact with the body tissue within the body cavity (FIG. 2). The volume of the stimulation means can thus be adjusted to the size of the body cavity such that a good contact is achieved with the body tissue prior to a vibrational stimulation. A good and/or close contact refers to such a contact that the available outer surface of the stimulation means in a second, at least partly expanded state, essentially abuts against the surface of the body tissue. The stimulation means preferably abuts against the body tissue with a measurable, controllable, low pressure.

In an embodiment of the invention, the stimulation means has a smooth outer surface. The outer surface of the stimulation means is for instance made of a material such that its outer surface is smooth or in another way minimizes friction when in contact with body tissue in a body cavity or the nasal cavity. The outer surface of the stimulation means can also comprise a lubricant for facilitating passage through the body opening. The stimulation means can e.g. be coated with a lubricant, such as e.g. a paraffin solution.

In an embodiment of the invention, the stimulation means is elastic. The stimulation means is e.g. made of an elastic material. The size and volume of the stimulation means can then be varied by an inner pressure. This variation of the size and volume of the stimulation means is achieved by for instance control of fluid supply to the stimulation means. Supplying fluid to the stimulation means via a channel achieves expansion of the stimulation means, and removal of fluid from the stimulation means achieves compression of the same.

In an embodiment of the invention, the stimulation means is compressible to a first state of the device. In this case, the stimulation means is present in an expanded state at atmospheric pressure. The stimulation means can be transferred to a first state of the device, e.g. by external influence or pressure, outside the body cavity. The purpose of an external influence is to compress the stimulation means, for instance by removing fluid, such as air, from the same. The stimulation means thereby achieves a size and volume corresponding to the first state of the device, wherein the stimulation means is introducible into a body opening. Expansion of the stimulation means can occur, with certain temporary delay, when the external influence ceases, i.e. within a body cavity. In the body cavity, the device is transferred to the second state, wherein the stimulation means is at least partly expanded in order to provide as large contact surface as possible with the body tissue within the cavity. The compressible stimulation means is preferable made of an elastic material.

Figure 7:
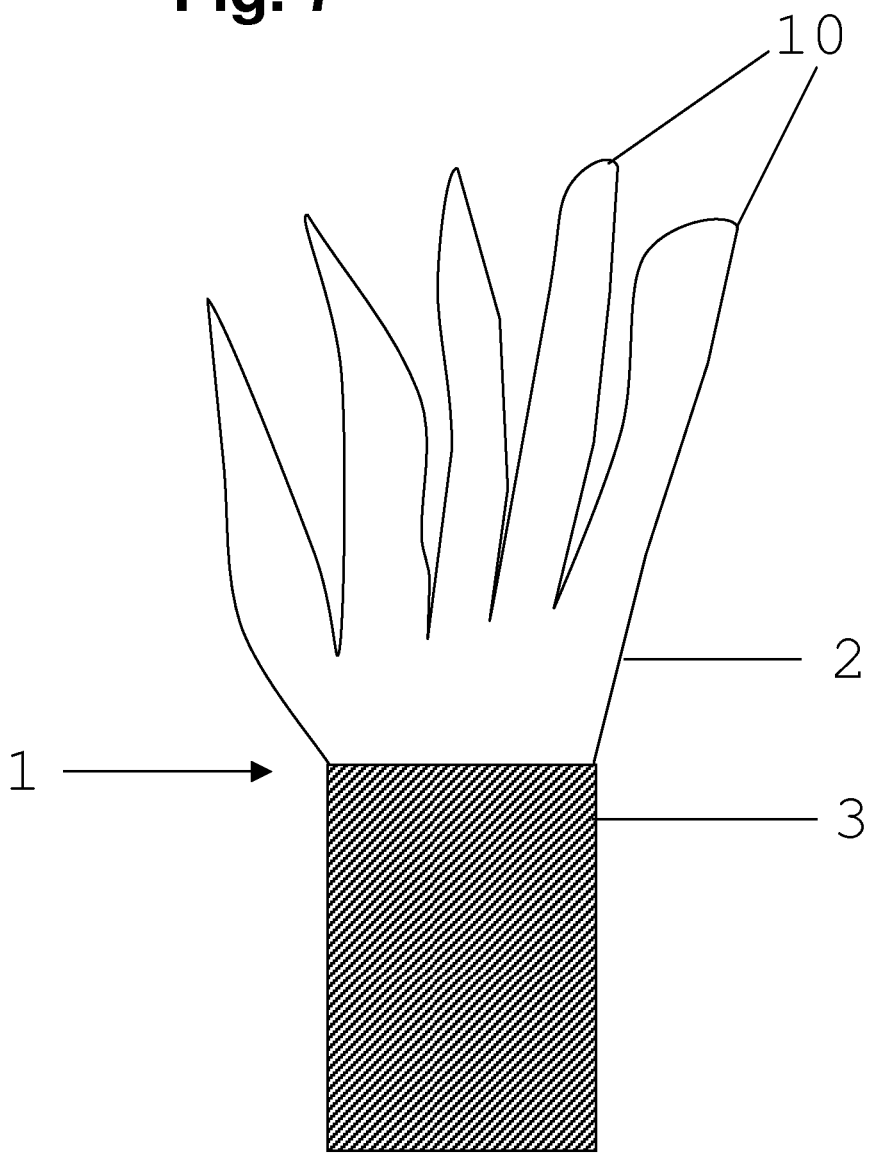
FIG. 7 schematically shows an embodiment of the device according to the invention, wherein the stimulation means is constituted of a number of arms.

In one embodiment, the stimulation means has a constant inner pressure, which is not regulated in connection to the treatment. The size and volume of the stimulation means must in this case be such that it can pass through the opening into the body cavity where treatment of the mucosa shall be performed. Having a suitable shape, the stimulation means can achieve a sufficiently large contact area against the mucosa to stimulate nerve endings and blood vessels in the mucosa by means of vibrations. An example of a device comprising a stimulation means with a constant inner pressure is shown in FIG. 7.

In another embodiment of the device according to the invention, the stimulation means is made of an inelastic material such that in the first state of the device, wherein the stimulation means is introducible into a body opening, the size of the stimulation means is decreased. In the second state of the device, the stimulation means is expanded for abutting against tissue surfaces.

The stimulation means can also have partly elastic properties, which makes it both shrink and fold when returning to the first state of the device. Typically, the stimulation means is made of a thin material which can fold.

In one embodiment of the invention, the stimulation means is preferably made of a material such that it does not chemically or biologically affect any body tissue with which it comes into contact.

In another embodiment, the stimulation means is made of a material such that it has a chemical or biological activity on the body tissue with which it comes into contact.

Alternatively, the surface of the stimulation means can be coated with a substance having a chemical or biological activity locally in the body cavity or in other parts of the body of the patient in order to achieve a medical purpose, e.g. reduce inflammation.

The stimulation means is for instance made of a plastic material or a rubber material. The stimulation means is preferably made of latex.

The stimulation means can be made of a material such that it does not release fluid contained in the stimulation means into a body cavity.

In another case, the stimulation means can be designed such that it has dosage openings for administration of chemical or pharmaceutical agents to surrounding body tissue.

The stimulation means can be made of a material such that it is semi-permeable to a fluid. A fluid contained in the stimulation means can at least partly be released into a body cavity or in the nasal cavity during treatment, e.g. for facilitating the frictionless movement of the stimulation means in the body cavity or the nasal cavity, and/or for medical influence on tissue as part of the vibrational treatment. In the case of treatment in the nose, such a fluid can for instance be saline.

A stimulation means which is semi-permeable to chemical, biological or pharmaceutical substances and which massages these substances into the tissue subject to treatment can for instance be suitable for treatment in e.g. blood vessels, intestine or gall ducts.

For administration of agents with chemical or pharmaceutical effect locally in a body cavity or peripherally in a patient, the surface of the stimulation means can be coated with such agents.

The dimensions of the stimulation means are suitably adapted to the size and shape of the body cavity to be treated. For instance in treatment of the mucosa in the nasal cavity of adults, it is for instance suitable if the length of the stimulation means in the depth of the nose is from approximately 3 mm to approximately 100 mm, preferably from approximately 40 to approximately 60 mm, dependent on the degree of expansion of the stimulation means and the size of the nasal cavity. The stimulation means is preferably longer than 100 mm in the case of treatment of the nasal cavity of snoring patients to achieve stimulation far back in the palate.

Further, the width of the stimulation means laterally in the nose can for instance vary from approximately 1 mm to approximately 40 mm, preferably from approximately 10 to approximately 20 mm, dependent on the degree of expansion of the stimulation means and the size of the nasal cavity. In newborns, the stimulation means can in a first state of the device be e.g. approximately 20 mm long and approximately 1 mm wide. In an expanded second state of the device, the stimulation means can be approximately 20 mm long and approximately 3 mm wide. It is understood that the dimensions of the stimulation means can vary outside of the intervals given above.

For treatment of certain other body cavities, for instance the intestine of adults, it is suitable if the length of the stimulation means is from approximately 10 mm to approximately 200 mm, preferably from approximately 100 mm to approximately 200 mm, e.g. approximately 150 mm, dependent on the degree of expansion of the stimulation means and the size of the body cavity. Further, the width of the stimulation means in certain other body cavities, e.g. the intestine of adults, can vary from approximately 1 mm to approximately 40 mm, preferably from approximately 10 mm to approximately 20 mm, dependent on the degree of expansion of the stimulation means and the size of the body cavity.

It is understood that the shape of the stimulation means in the second state of the device is adapted to the size and shape of the body cavity. In for instance the nasal cavity, the stimulation means in the expanded state can for instance have a circular, oval or droplet shape.

The vibration means of the device according to the invention is arranged to bring the stimulation means to vibrate. An example of a vibration means comprises e.g. a vibration generator arranged within the stimulation means, to which an electrical current is conducted from an external source. In this embodiment, the vibration means comprises the in this case required electrical circuits as well as the vibration generator.

In another embodiment of the device according to the invention, the vibration means comprises an externally arranged vibration source, i.e. outside the stimulation means but connected to the device. This external vibration source is preferably arranged so as to supply vibrations to a fluid contained in the device. An example of a vibration device comprises a signal generator, for instance a tone generator. Other vibration sources that are suitable for the device according to the invention are known to the skilled person.

The vibration means is arranged to bring the stimulation means to vibrate at a frequency of 1-5000 Hz, more preferably at a frequency of approximately 10-100 Hz, more preferably at a frequency of approximately 30-70 Hz, and most preferably at a frequency of approximately 35-60 Hz.

In an embodiment of the device according to the invention, the volume of the stimulation means can be controlled by expansion means 3. In an example of the present embodiment, the expansion means further comprises at least one channel for supplying fluid to the stimulation means to achieve expansion.

The volume of the stimulation means can be adapted by supplying a fluid, e.g. a gas, such as air, or a liquid, to the vibration device via the expansion means. This supply can be regulated by an external apparatus via the expansion means. An example of such an apparatus is a cylinder with a movable plunger that can be moved back and forth to regulate the amount of fluid in the cylinder, and thereby regulate the amount of fluid in the expansion means.

The expansion means preferably comprises at least one channel. An example of such a channel is a tubing. An external apparatus can via connection to a channel regulate the fluid supply and thereby the volume of the stimulation means.

Typically, the expanded stimulation means has, in the second state of the vibration device, inside a body cavity an inner pressure that only to a small extent, if any, exceeds the surrounding atmospheric pressure, such that the stimulation means only exerts a (controllable) low pressure on surrounding tissues.

The connection between the stimulation means and the expansion means comprising a channel in applicable cases allows free passage of a fluid, e.g. a liquid or a gas, between the stimulation means and the channel without fluid leaking to surrounding tissue.

To the fluid that is supplied to the stimulation means through at least one channel can further be supplied vibrations for vibrating the stimulation means. The vibration means in this case supplies vibrations to the fluid, which functions as a medium for transferring vibrations to the stimulation means. Vibrations are mediated via the fluid in one or more channels to the stimulation means. In those cases where the vibration device comprises a stabilizing section, arranged at least partly within the stimulation means, the vibrations are mediated to this section as well such that the stimulation means via its contact surface with body tissue achieves vibrational stimulation of the body tissue. The vibration means can comprise an external vibration source which mediates vibrations via the fluid to the stimulation means.

FIG. 1 schematically shows an embodiment of the device according to the invention arranged in a second state, wherein the stimulation means or member 2 is expanded. The vibration device 1 comprises an expandable stimulation means or member 2 and an expansion means or member 3. In this embodiment, the stimulation means 2 is arranged partly around the expansion means 3, such that one end of the expansion means is located freely inside the stimulation means. The stimulation means 2 could also be arranged in direct connection to the end of the expansion means 3, or as a sleeve around the expansion means 3 some distance away from said end. It is understood that these are only examples of how a stimulation means can be arranged to an expansion means and that other examples are possible within the scope of the invention.

The expansion means 3 preferably comprises at least one channel 4 for supplying fluid to the stimulation means 2. The stimulation means is then connected to the expansion means in such a way that a fluid freely can pass from the channel to the stimulation means. Typically, the vibration device is closed such that a fluid can not leak out inside the body opening of a patient. Examples of an expansion means comprising at least one channel is a pipe, a tubing, a conduit, a cylinder, a tube etc. The expansion means can for instance be made of a plastic, rubber or metal material and can thus have properties that are specific for the material in question. In one case, the expansion means can be long, e.g. one meter in length, and flexible so as to allow the device access to spaces that are difficult to access in the human or animal body, e.g. in the intestine and blood vessels. In case of treatment in the nasal cavity, the preferred length of the expansion means is between 70 mm and 300 mm, while the preferred width is preferably between 1 mm and 15 mm. In case of treatment in the intestine, the preferred length of the expansion means is between 50 cm and 150 cm, preferably between 80 cm and 100 cm, while the preferred width is between 10 mm and 30 mm, preferably between 10 mm and 20 mm, e.g. 15 mm.

The stimulation means can for instance be rigid or flexible dependent on which body cavity shall be treated.

A fluid can preferably be supplied to and removed from the stimulation means 2, i.e. the stimulation means is arranged so as to have the capacity to contain a fluid. The stimulation means has at least one cavity intended for fluid supply. An example of a stimulation means is a balloon, which in at least partly expanded state establishes the contact surface of the device against body tissue in a body cavity. Other examples of stimulation means are bags, bubbles, foam devices etc.

FIG. 2 schematically shows how an embodiment of the device 1 according to the invention can be used in a human nasal cavity. It is understood that this is just an example of use of the present invention in a body cavity. One end of the expansion means 3 is typically outside the nose or body opening throughout the entire treatment. The stimulation means 2 is intended to be in close contact with the tissue surface to be treated and can be designed in multiple ways provided that it gives a good contact surface against surrounding tissues.

The stimulation means 2 is designed so as not to have any sharp edges or points, so that it does not damage any tissue with which it comes into contact. A lubricant can be used on the surface of the stimulation means 2 to ensure that the stimulation means 2 can slide frictionless on tissue surfaces.

The method according to the invention provides treatment of a mucosa in a body cavity. Treatment of tissue in a body cavity will now be exemplified with treatment in the nasal cavity.

A vibration device comprising expandable stimulation means is provided. The non-expanded stimulation means 2 is then introduced via the nostril into the nasal cavity. The vibration device is thus preferably in a first, essentially non-expanded state when introduced to facilitate passage through the nostril and to minimize the frightening effect a bulky instrument can have on a patient.

The stimulation means 2 is then expanded to a second state of the device inside the nasal cavity. If the stimulation means were in a first state of the device when introduced, expansion occurs when the stimulation means is at least partly introduced in the nasal cavity according to FIG. 2.

By e.g. expansion means 3 the stimulation means can be expanded at least partly to a size and/or volume which is suitable for treatment. The stimulation means is preferably expanded by supplying fluid to the stimulation means through one or more channels, which are comprised in the expansion means. The volume of the stimulation means is thus regulated through the inner pressure that is accomplished within the stimulation means by the supply of fluid. The fluid can for instance be supplied from an external source (not shown) that is connected to the expansion means.

The pressure within and the volume of the at least partly expanded stimulation means provides a good contact with surrounding body tissues, in particular the tissues whose nerve endings and blood vessels shall be treated by the treatment according to the invention. The at least partly expanded stimulation means 2 has with its outer surface preferably contact with a larger tissue surface, whereby a larger number of nerve endings and/or blood vessels can be stimulated simultaneously when the vibration device is brought to vibrate.

The stimulation means preferably has an inner pressure which provides contact between the outer surface of the stimulation means and surrounding tissue.

Figure 5:
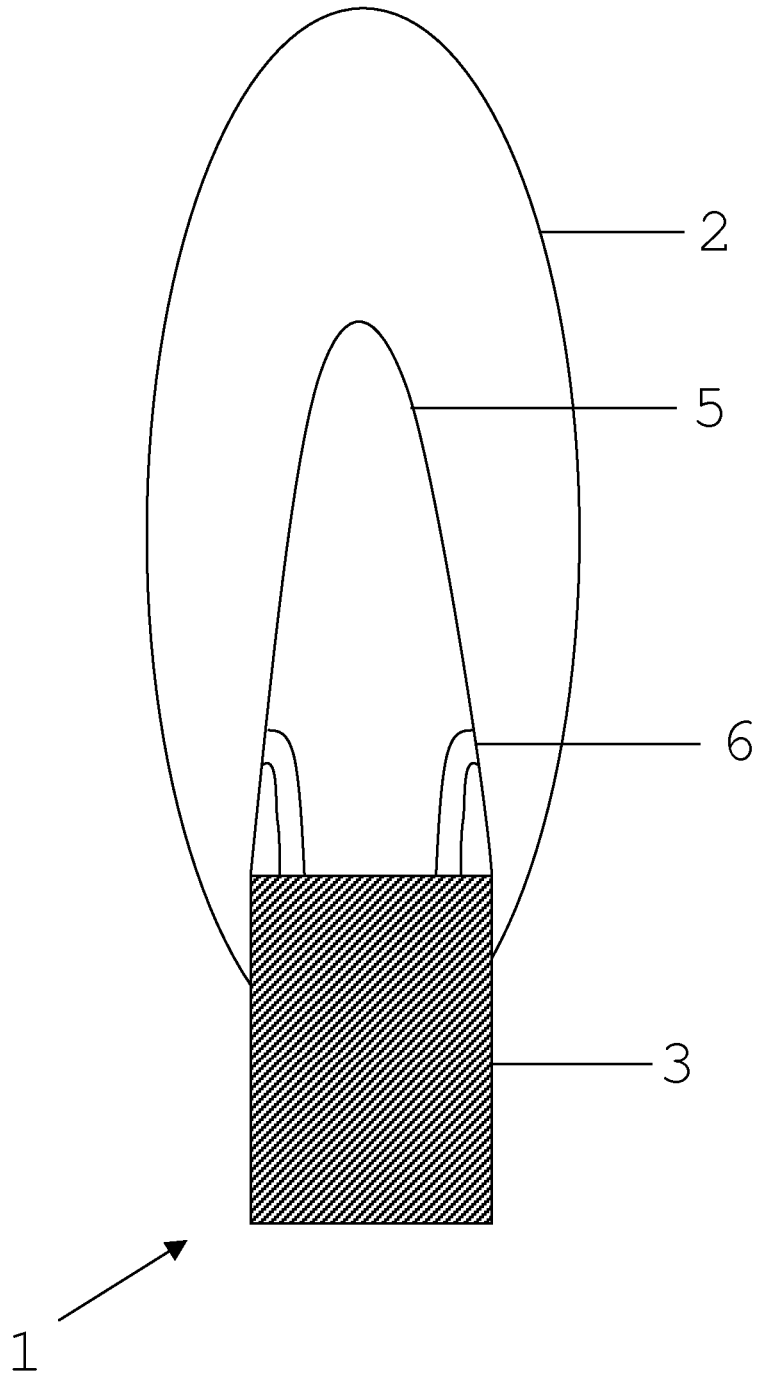
FIG. 5 schematically shows an embodiment of the vibration device according to the invention comprising a stabilizing section, which here is arranged within the stimulation means.

The stimulation of tissue with vibrations is preferably started when the stimulation means has obtained the desired volume. In cases where the tissue is swollen such that the stimulation means can not expand to the preferred, suitable volume, vibrational stimulation can be started when the stimulation means is completely or partly non-expanded, i.e. compressed. In one embodiment, a stabilizing section 5 according to FIG. 5 gives the stimulation means a suitable shape even if its inner pressure is not sufficient to give the stimulation means a specific shape or volume.

The volume of the stimulation means can be regulated during the treatment as surrounding tissues react to the vibrational stimulation and decongestion occurs. Likewise, the pressure exerted on surrounding tissue by the stimulation means can be regulated or varied during a vibrational stimulation.

The vibrational stimulation comprises bringing the stimulation means to vibrate in a body cavity for a period of time, preferably from approximately 1 second up to approximately 30 minutes, more preferably from approximately 15 seconds to approximately 7 minutes.

The vibrational stimulation of the method according to the invention can be performed at various frequencies, amplitudes and other conditions for the desired vibration pattern. The stimulation is preferably conducted at a frequency of between 1-5000 Hz, more preferably approximately 10 to approximately 100 Hz, more preferably approximately 30 to approximately 70 Hz, and most preferably approximately 35 to approximately 65 Hz, but other frequencies are also anticipated. The vibration device preferably vibrates with an amplitude of between approximately 0.05 mm and approximately 20 mm, more preferably 0.3 mm and approximately 5 mm, but other amplitudes are also anticipated. What vibrational conditions are selected partly depends on which cavity and what treatment is desired or which possible condition of the patient that shall be treated.

The method according to the invention can utilize a system comprising an external vibration source, which is handled by either a trained operator, e.g. a doctor or a nurse, or the patient himself. Said system can be immobilized to a support or the like, or handled ad lib by the operator or the patient.

After conducting a desired vibrational stimulation of body tissue for an appropriate period of time, the treatment can suitably be terminated. The at least partly expanded stimulation means is suitably returned to the essentially non-expanded state, the first state of the device, before it is removed through the body opening, e.g. the nostril. This possible decrease of volume of the stimulation means can for instance be achieved by reduction of the fluid pressure, e.g. the air or liquid pressure, by the expansion means, whereby the pressure in the stimulation means is decreased. After lowering the pressure, the stimulation means thus returns to the non-expanded state. If a stabilizing section 5 is present in the device, this can to some extent maintain a certain shape and volume of the device.

After the stimulation means has regained a size such that it can pass through out of the body opening, e.g. the nostril, the operator or patient can pull the vibration device out of the body opening, e.g. through the nose.

In one embodiment of the method according to the invention, a vibration device according to the first aspect of the invention is utilized.

To enable introduction of the vibration device according to the invention into a body opening as easy as possible, in view of the size of the relevant body opening and the possibly frightening effect that a voluminous vibration device can have on a patient, it is desirable that the non-expanded stimulation means is as small as possible. It is also desirable that the vibration device can be packed, stored and transported in a suitable way.

The expandable stimulation means of the device according to the invention can be arranged in the first state of the device in a non-bulky manner. In one embodiment, in which the device comprises expansion means 3, the stimulation means 2 can be arranged in the first state contained in the expansion means. In the cases where the expansion means 3 comprises a channel 4, the stimulation means 2 can be arranged in the first state contained in the channel, see e.g. FIG. 3*a*. If the stimulation means is used together with a lubricant, this lubricant can also be contained within the channel.

Figure 3A:
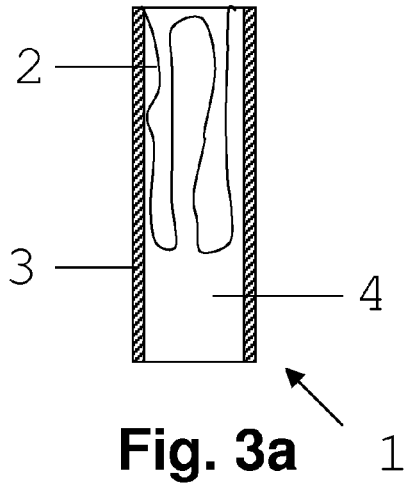
FIG. 3*a* schematically shows an embodiment of the vibration device according to the invention arranged in the first state, wherein the stimulation means is contained in a channel of the expansion means.
Figure 3B:
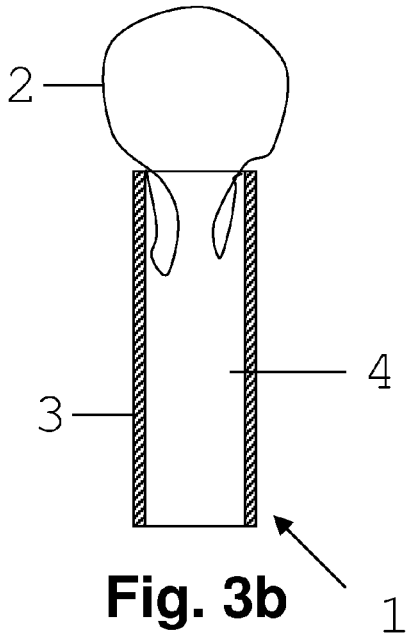
FIG. 3*b* schematically shows an embodiment of the vibration device according to the invention arranged in an intermediate state, wherein the stimulation means is partly expanded.
Figure 3C:
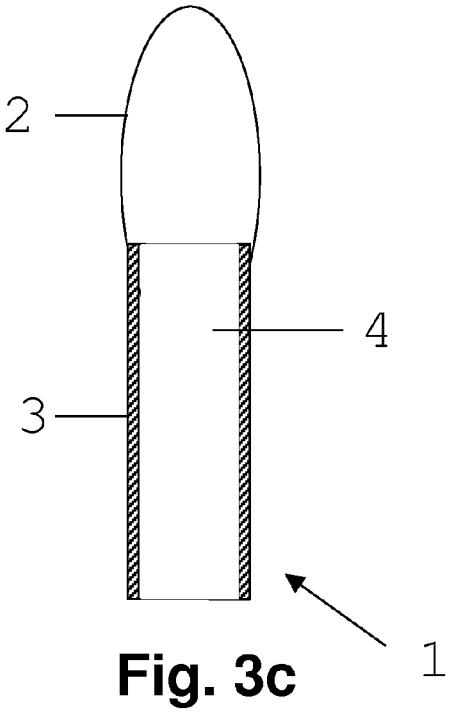
FIG. 3*c* schematically shows an embodiment of the vibration device according to the invention arranged in a second state, wherein the stimulation means is essentially expanded.

In treatment with the device according to the invention comprising a stimulation means arranged according to the embodiment above, the device is introduced into a body opening with the stimulation means completely or partly contained in the expansion means, for instance the channel 4 (FIG. 3*a*-3*b*). Expansion of the stimulation means 2 occurs within the body cavity after passage through a possibly narrower body opening, e.g. a nostril. The stimulation means 2 can for instance be moved out of the expansion means 3, e.g. the channel 4, by filling the vibration device through the expansion means 3 with a fluid, which provides a pressure that forces the stimulation means 2 out of the channel 4. The stimulation means is thereby expanded (FIG. 3*b*-3*c*).

Figure 4A:
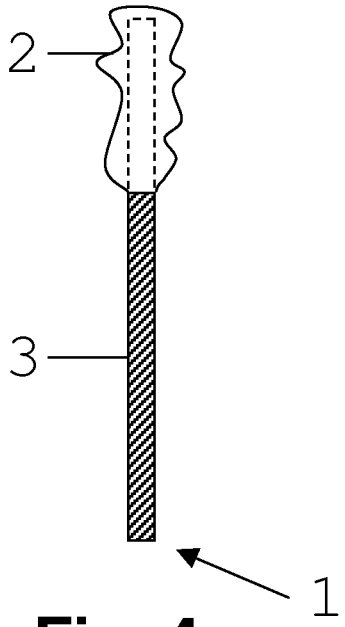
FIG. 4*a* schematically shows an embodiment of the vibration device according to the invention arranged in the first state, wherein the stimulation means is arranged around the expansion means.
Figure 4B:
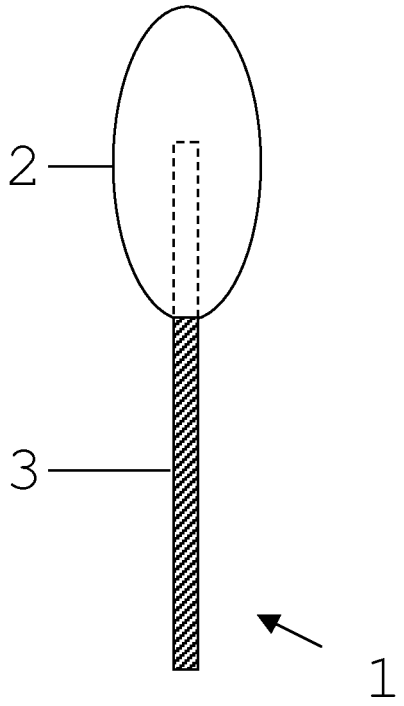
FIG. 4*b* schematically shows an embodiment of the vibration device according to the invention arranged in the second state, wherein the stimulation means is expanded.

Another example of a vibration device according to the invention in a non-bulky first state is shown in FIG. 4*a*-4*b*. In this case, the stimulation means 2 in the first state of the device 1 is arranged around the expansion means 3 in FIG. 4*a*. In the first state of the device, the stimulation means can for instance be folded or pleated around the expansion means or, in the cases where it is present, around the stabilizing section. Following introduction via a body opening into a body cavity, the stimulation means is completely or partly expanded inside the body cavity (FIG. 4*b*).

In another example of a vibration device according to the invention, the stimulation means in the first state of the device is arranged around the expansion means, optionally including a stabilizing section, but does not surround the penetrating end of the expansion means. In this case, it is desirable that the penetrating end, optionally coated with a lubricant, is made of a soft and tissue-friendly material so as not to damage the tissue within the body opening or body cavity. Following introduction via a body opening into a body cavity, the stimulation means is completely or partly expanded inside the body cavity, forming a sleeve around the expansion means some distance away from its penetrating end.

Regardless of how the stimulation means is arranged in the first state of the device according to the invention, an outer packing for the device can be suitable. An outer packing (not shown) can assist in securing the hygiene of the device, protect the sensitive parts of the device from mechanical or chemical influence, as well as ensure that any lubricants, other substances, volatile substances or parts of the device do not disappear or degrade during transport and storage.

In one embodiment of the vibration device according to the invention, said device comprises a stabilizing section. A stabilizing section 5 can be arranged to for instance facilitate the introduction and/or control of the position of the stimulation means within the body cavity, in particular to make the stimulation means in the first state of the device assume the desired position inside the body cavity. A stabilizing section 5 can for instance be arranged within the stimulation means 2 (FIG. 5). The stabilizing section can also be arranged solely in the expansion means 3 (not shown) or in both the stimulation means and the expansion means.

In FIG. 5 is shown an embodiment of the device according to the invention, wherein the stimulation means comprises a stabilizing section 5. The stabilizing section does preferably not come into direct contact with the tissue in a body cavity, but is contained in its entirety by the stimulation means. The stabilizing section 5 preferably comprises at least one connection 6 between the channel of the expansion means and the interior of the stimulation means 2 to allow supply of fluid to the stimulation means.

The stabilizing section is preferably brought to vibrate according to essentially the same vibration pattern as is the stimulation means. Body tissue that comes into contact with the stabilizing section through the surface of the stimulation means without intermediate fluid is stimulated with a vibration pattern that corresponds to the vibration pattern that is propagated through the other surfaces of the stimulation means when the stimulation means is in an at least partly expanded state.

The stabilizing section is made of a soft and flexible material, which facilitates passage through a body opening. The stabilizing section is suitably made of a silicone, plastic or rubber material. Use of other materials is also anticipated.

The stabilizing section 5 according to FIG. 5 preferably has a rounded shape to avoid damage to the stimulation means and/or surrounding tissues within a body cavity. The stabilizing section suitably has an upper end with a dimension (cross-section) that is less than the dimension (cross-section) of a lower part of the section, to facilitate introduction of the stimulation means comprising the stabilizing section into narrow passages inside a body opening.

When the stimulation means is expanded in the second state of the device, the stabilizing section may lack direct physical contact with the inner surface of the stimulation means. The stabilizing section preferably allows mediation of vibrations to the stimulation means; the vibration pattern is only prevented or suppressed to a little, if any, extent by the stabilizing section. In the case where the vibration means supplies vibrations to a fluid, it may e.g. be suitable if this fluid can flow without obstruction by the stabilizing section 5 of FIG. 5.

Alternatively, the stabilizing section has such size and shape that it completely fills the stimulation means, there not being any space for a fluid in the stimulation means. In this case, the stabilizing section is preferably made of a soft and flexible material. In this case, the stabilizing section can serve the purpose of the stimulation means and replace the stimulation means.

A stimulation means with a static inner pressure can also comprise a stabilizing section according to FIG. 5. In this embodiment, the expansion means 3 preferably also comprises at least a part of the stabilizing section.

During the course of the method of treatment, the stimulation means is introduced into the nasal cavity, intestine or other body cavity, e.g. by means of an expansion means, a stabilizing section or possibly other equipment.

The expansion means comprises in one embodiment a stabilizing section to facilitate introduction of the vibration device via the body opening into the body cavity.

An expansion means comprising a stabilizing section facilitates e.g. further simple positional control of the vibration device outside a body cavity as well as inside the body cavity and also when it is introduced into and withdrawn from the body cavity. In this embodiment, the stabilizing section preferably has dimensional stability and optionally rigidity to enable control of the position and direction of the stimulation means inside the cavity. The expansion means comprising a stabilizing section can have a straight shape and be relatively rigid. Alternatively, the expansion means comprising the stabilizing section can deviate from the straight shape and e.g. be curved or bent.

If a stabilizing section is contained in the expansion means, said section can e.g. be made of an inelastic but flexible tube and a surrounding structure that provides stability to the section and the expansion means. The section can also be constituted solely of a tube.

In one embodiment of a vibration device according to the invention, the stimulation means is surrounded by an exchangeable hygienic protective cover 7. A hygienic protective cover 7 can for instance enable use of the device on more than one occasion, since a hygienic protective cover 7 prevents spread of hazardous substances, like dirt or other biological or chemical material (FIG. 6*a*).

Figure 6A:
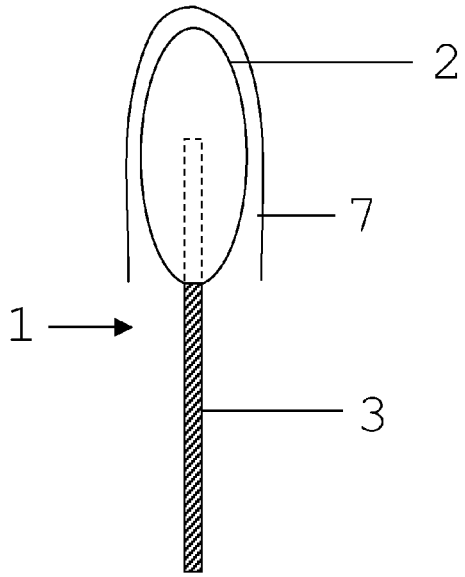
FIG. 6*a* schematically shows an embodiment of the vibration device according to the invention comprising an exchangeable hygienic protective cover.
Figure 6B:
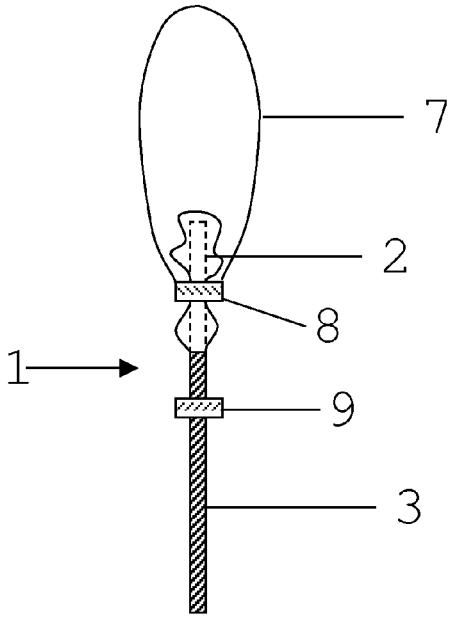
FIG. 6*b* schematically shows an embodiment of the vibration device according to the invention, which is provided with an exchangeable hygienic protective cover.
Figure 6C:
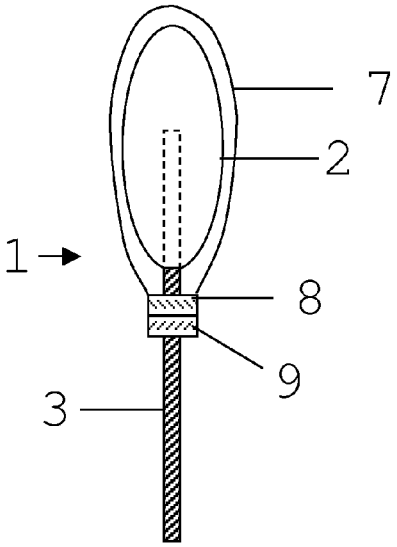
FIG. 6*c* schematically shows an embodiment of the vibration device according to the invention, which is provided with an exchangeable hygienic protective cover.

The hygienic protective cover 7 in FIG. 6*a*-6*c* surrounds the device 1 in such a way that any hazardous or contagious substances on the surface of the stimulation means 2 can not come into direct physical contact with surrounding tissues.

The hygienic protective cover 7 should be readily exchangeable. When the hygienic protective cover is arranged in the device 1, it is detained by means of e.g. a support 8 on the hygienic protective cover and a support 9 on the expansion means, so that it does not easily fall off the device. Problems caused by the protective cover e.g. getting stuck or remaining in the relevant body cavity or opening after treatment are thereby avoided. This eliminates for instance the risk of a hygienic protective cover ending up in the patient's respiratory tract and exposing the patient to danger and discomfort when treating the nasal cavity. FIG. 6*a*-6*c* shows an example of how a hygienic protective cover 7 can be arranged to an expansion means 3, wherein a firm connection of the hygienic protective cover to the device 1 is accomplished, as well as complete enclosing of the stimulation means 2.

The hygienic protective cover mediates vibrations from the stimulation means to surrounding tissues. The hygienic protective cover can be elastic so that its size is varied in relation to the volume of the enclosed stimulation means.

Further, the hygienic protective cover as well as the stimulation means can preferably readily pass in or out of the body opening and to or from the body cavity where treatment shall be performed. The hygienic protective cover thus preferably has a smooth outer surface or causes in another way as low friction as possible towards surrounding body tissues.

In one example of an embodiment of a device, the device comprises a hygienic protective cover, which essentially lacks pharmaceutical, chemical or biological effect on surrounding tissues.

Alternatively, the hygienic protective cover has a chemical or biological effect on surrounding tissues in order to achieve a medical purpose, e.g. reduce inflammation.

A lubricant can for instance be used together with the hygienic protective cover, which lubricant essentially lacks pharmaceutical, chemical or biological effect on surrounding tissues. The hygienic protective cover can be coated with a lubricant, e.g. be dipped in a paraffin solution.

The hygienic protective cover is preferably a disposable product, i.e. is not intended to be used at more than a single treatment occasion in a body cavity.

In the case where the vibration device itself is a disposable product, the hygienic protective cover can be constituted by the stimulation means and does consequently not need to be exchangeable.

If the vibration device according to the invention is intended to be used with a hygienic protective cover, there is no need for the stimulation means per se to be made of any tissue-friendly material, since this material then does not come in contact with tissues during the treatment.

In an embodiment of the vibration device according to the invention, there is no space for fluid in the stimulation means. Such a vibration device can be exemplified by a device according to FIG. 7, wherein the stimulation device 2 comprises an optional number of arms 10 made of a soft and ductile material, e.g. silicone, plastic or rubber. The arms can be compressed when they are introduced through a body opening, so that their total available outer surface first is decreased, and thereafter be expanded within a body cavity, so that the arms spread out and their total available outer surface is maximized. The arms are distributed over a large surface area so that a good and tight contact is achieved between the device and the body tissue. The arms can have a static inner pressure and/or be expanded without fluid supply. Fluid supply may however occur anyway, e.g. to administrate substances with medical or other biological effect through dosage openings in the arms.

Figure 8A:
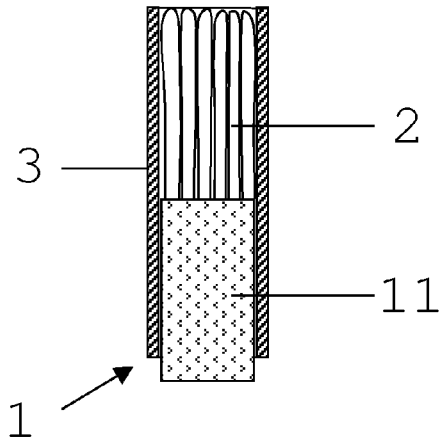
FIG. 8*a* schematically shows an embodiment of the device according to the invention arranged in the first state, wherein the stimulation means is contained in the expansion means and wherein the stimulation means is constituted of a number of resilient arms.
Figure 8B:
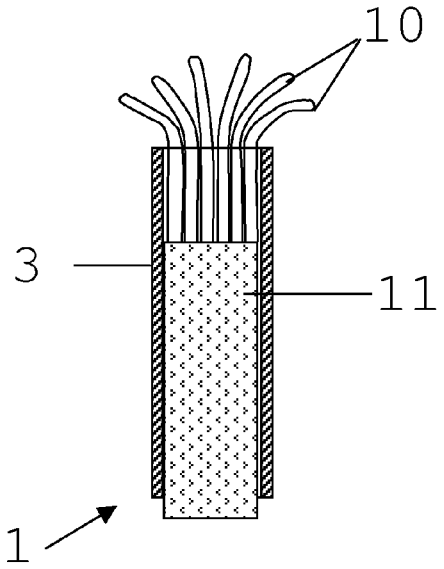
FIG. 8*b* schematically shows an embodiment of the device according to the invention arranged in an intermediate state, wherein the stimulation means is partly expanded and wherein the stimulation means is constituted of a number of resilient arms.
Figure 8C:
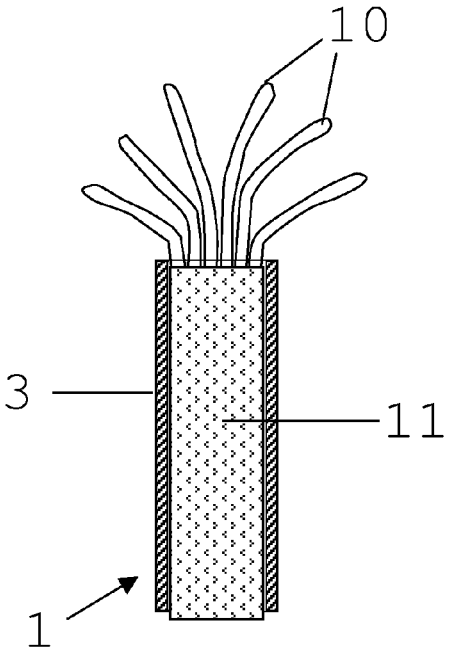
FIG. 8*c* schematically shows an embodiment of the device according to the invention arranged in the second state, wherein the stimulation means is expanded and wherein the stimulation means is constituted of a number of resilient arms.
Figure 9:
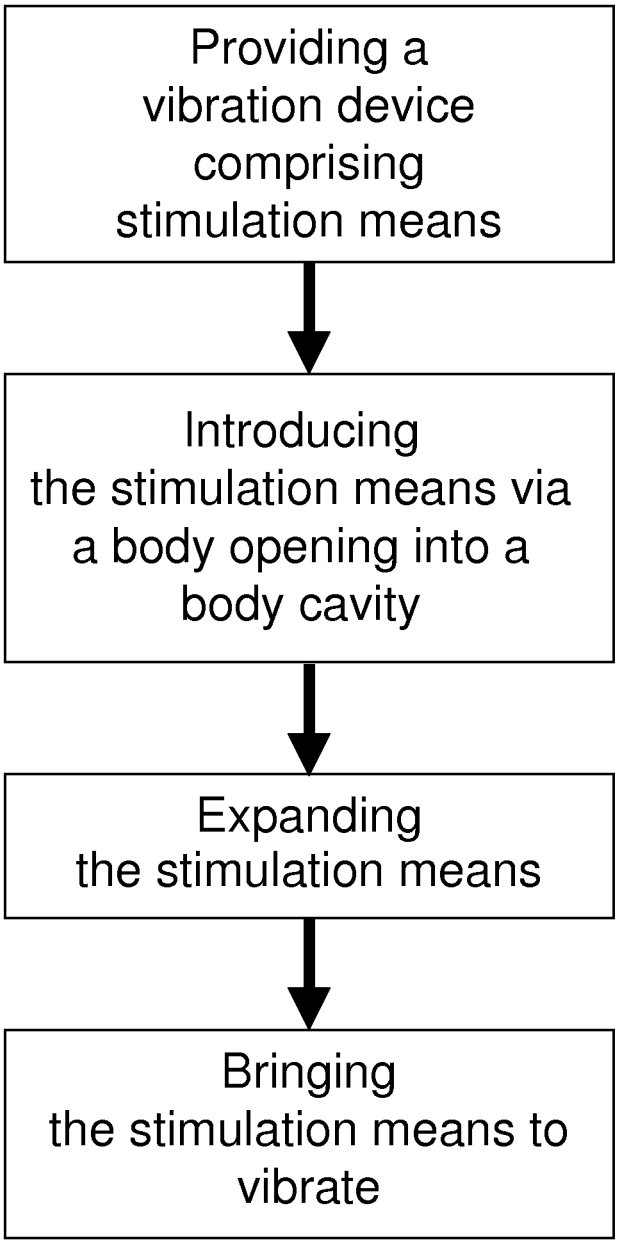
FIG. 9 is a flow chart which shows the steps for vibrational stimulation according to an embodiment of the method according to the invention.

Said arms 10 can for instance be resilient, which is shown in FIG. 8*a*-8*c*. Resilient arms can in a first state of the device be contained in the expansion means, e.g. in a channel of the expansion means (FIG. 8*a*). The arms 10 can for instance be transferred to a second state of the device by an element 11 pushing the arms out of the expansion means, e.g. out of the channel (FIG. 8*b*). An element can be e.g. a fluid or a solid material, such as a plunger. After introducing the device into a body cavity, the arms are distributed within the body cavity, which results in that the device is brought into a second state and that a large area of tissue is reached (FIG. 8*c*). A good and tight contact between the stimulation means and the body tissue is thus achieved before vibrational stimulation is started. It is understood that the more arms comprised in the stimulation means, the larger available surface is achieved for abutting against body tissue. In total, the area of the tissue surface in the body cavity that is reached by the arms of the stimulation means 2 can be larger that the area of the body opening that the stimulation means passes to enter into the body cavity.

In the case where the stimulation means has a static inner pressure, the stimulation means in the first state of the device can be contained in the expansion means. For treatment with vibrations in a body cavity, there occurs an expansion of the stimulation means to the second state of the device, e.g. by the stimulation means being pushed out by an element according to FIG. 8*b*.

The vibration device according to the invention can also comprise for instance a safety valve, which in case the device is supplied with fluid at a too large pressure can release some of it, so that the pressure of the device is brought down to a suitable level.

The device can be connected to an external apparatus and e.g. a handle for handling the vibration device.

When the device according to the invention is in the second state, with an at least partly expanded stimulation means, the stimulation means is brought to vibrate. The vibrations are preferably transferred to the body tissue having the nerve endings and blood vessels to be stimulated in a body cavity by direct physical contact between the outer surface of the stimulation means and the tissue surface.

A vibration device according to the present invention can be brought to vibrate with various oscillation patterns depending on the embodiment of the device and the treatment type concerned.

A device according to the present invention can be brought to vibrate with a pattern that implies that the volume of the stimulation means oscillates. The device can also be brought to vibrate by a longitudinal motion of the stimulation means in parallel to the expansion means. The device can also be brought to vibrate by an oscillation around an optional major axis. The device can also be brought to vibrate by a translational movement in an optional plane. The oscillations of the stimulation means can also be a combination of the oscillation patterns described above, or oscillate in a way that is suitable in consideration of the field of application concerned.

When treating the nasal cavity of a patient, the vibration device according to the invention is usually brought to vibrate at a frequency of preferably approximately 30-70 Hz, but other oscillation frequencies can occur in other treatments. The neurological effect of the vibration device on the nerve endings in treated body tissue is to a large extent governed by the specific frequency or frequencies used in the treatment.

When treating body tissue by a vibration device according to the invention, the effect of the device on the nerve endings in treated tissue also depends on the magnitude (amplitude) of the oscillations to which the tissue are exposed by the stimulation means. Typically, the surface of the stimulation means is brought to vibrate with an amplitude of between 0.05 mm and approximately 20 mm, more preferably 0.3 mm and approximately 5 mm, but the amplitude required for a certain treatment is governed by the nature of the relevant body opening, the sensitivity of the patient in question, and what type of treatment is intended to be carried out.

The vibration device according to the invention can be bought to vibrate with various wave patterns depending on field of application. The vibration device can for instance be brought to vibrate in such a way that the vibrations can be described with a sinus wave or as a square wave, in the later case with a "duty cycle" of between 0.1 and 0.5. Other wave shapes, similar to those described above or not, can also be suitable in the present case.

Pilot Tests

Pilot tests were conducted with a device and a method according to the invention. The tests were conducted in the nose of adult healthy individuals and patients with various types of problems and/or diseases associated with the nasal region.

In all tests made so far, a vibration device comprising a stimulation means connected to a vibration means and an expansion means has been used.

The stimulation means was a balloon which in an expanded, second state had a diameter of 1.5 cm and a length of 5 cm. The balloon was connected with an expansion means comprising a channel. A tubing having a length of 15 cm was used for this purpose. The tubing and the balloon were connected to each other such that one end of the tubing resided within the balloon, having a length of maximally 4 cm to simplify introduction into the nasal cavity. The tubing supplied fluid, in this case air, to the balloon for expanding the same. The other end of the tubing was connected via a three-way cock to a graduated syringe (20 ml) as well as to another tubing, which was connected to a closed air system. The closed air system was connected to a flexible membrane, which in turn was connected to a tone generator with a variable frequency in the interval 10-100 Hz. The air pressure could be varied in a controlled manner within a pressure interval of 0-100 cm water (0-9.8 kPa). The amplitude of the oscillating membrane could be varied in a controlled manner (in arbitrary but reproducible units). Prior to use, the balloon was provided with a hygienic protective cover, consisting of a finger from a disposable glove. The hygienic protective cover was dipped in a paraffin solution prior to each introduction into a nasal cavity.

Method of Treatment

The following general method was used for all treatments:

The vibration device in a first state with the balloon and its hygienic protective cover in a non-expanded state was introduced into the nasal cavity. Inside the nasal cavity, the balloon was expanded to a water pressure of 40-80 cm (3.9-7.8 kPa).

Vibrations in the interval 39-60 Hz were achieved by varying the air pressure in the closed system with little variations around the selected pressure within the interval of 40-80 cm water pressure (3.9-7.8 kPa) via the balloon by controlled movements of the flexible membrane by means of the tone generator. The stimulation was conducted in the nasal cavity for 5 to 10 minutes.

The air was then evacuated from the balloon such that the balloon was transferred to a non-expanded state. The balloon was withdrawn from the nasal cavity, and the hygienic protective cover was removed.

A new protective cover was placed over the balloon and dipped in paraffin solution prior to introduction into the second nasal cavity. According to the method above, the balloon was expanded within the nasal cavity to a water pressure of 40-80 cm (3.9-7.8 kPa). Vibrations with frequencies in the interval 39-60 Hz were achieved for a time period of 5-10 minutes.

Tests according to the above were conducted on healthy individuals and patients, and the result of the treatment was evaluated as effect of air passage through the nasal cavity, i.e. subjectively evaluated degree of nasal breathing resistance. The patients estimated their nasal passage before and after treatment on a visual analogue scale (VAS) from 0-10, wherein 0 corresponds to no resistance, and 10 corresponds to maximal resistance, i.e. completely congested passage.

The results for the various groups of patients and individuals are described below.

Healthy, Symptom-Free Individuals

Healthy individuals were treated in both nasal cavities, one nasal cavity at a time, according to the above general method of treatment (frequency 40 Hz, 5 min, pressure 50 cm water (4.9 kPa)). Within 15 minutes after accomplished treatment of both nasal cavities, the breathing resistance was estimated on a VAS scale.

All individuals experienced a lowered breathing resistance. The breathing resistance for the group had decreased from on average 3 to 1 on the VAS scale. The bilaterally more open nasal passage was described to last for at least 2 hours. In certain individuals, the more open nasal passage lasted for up to 4 hours.

Individuals Having Common Cold, but Otherwise being Healthy

The individuals clinically had an infection in the upper respiratory tract since 1-2 days, presumably due to a virus infection, which caused runny nose and impaired nasal passage, i.e. certain nasal congestion. All individuals were treated according to the above general method of treatment (pressure 70 cm water (6.9 kPa)).

All members of the group experiences a decreased breathing resistance after 10-15 minutes. The subjective breathing resistance decreased for all individuals, on group level from 8 to 3 on the VAS scale. The effect lasted for at least 2 hours, and in some individuals for more than 3 hours.

Patients Having Rhinitis Medicamentosa

Patients having rhinitis medicamentosa are dependent on decongesting nose drops for treatment of common cold or nasal sprays against nasal congestion, and therefore use these preparations usually every night and often also in daytime. Those patients that so far have been treated have utilized nose drops every night, and most of them every day as well. The addiction has been going on for at least a period of 2 years, and in some of the patients for as long period as up to 10 years. The cause of the start of the addiction is usually not known, but it is not uncommon that the nasal congestion started in connection to an infection in the upper respiratory tract with severe and lengthy nasal congestion. Some of the patients described persistent problems with nasal congestion after blows to the nose or after surgery of the outer nose or inside the nose. All studied patients described that they have been treated with most of the known pharmacological treatment regimens. Some of the patients also described that they have had nose surgery, inter alia been burnt in the nasal mucosa for the purpose of decreasing the congestion of the mucosa, i.e. "shrivelling".

All patients that were treated with the present method and the present device described that the previous pharmacological treatments did not have any effect after finished pharmacological treatment. All of the patients that had received surgery, some of them up to four times, moreover described the surgeries as lacking any effect, i.e. they did not alleviate the nasal congestion, which is why the addiction has continued.

After two, sometimes three, treatments according to the above-described method of treatment (frequency 48 Hz, pressure 40-50 cm water (3.9-4.9 kPa), in those who had received surgery of the nasal mucosa 70 cm water pressure (6.9 kPa)) for a time period of 7 minutes, the nasal congestion in daytime stopped completely in all patients (improvement from on average 8 to 2 on the VAS scale) for at least one month and up to at most 3 months, which corresponds to maximal follow-up time so far.

In certain patients, the nasal congestion at night also stopped (improvement from on average 9 to 2 on the VAS scale) after the treatment. These patients were thus completely free of symptoms for up to 3 months.

Those patients that responded the least on the treatments were all free of symptoms in the daytime (see above), but 5-10 days after the treatment, they again experienced some one-sided, but on alternating sides, nasal congestion at night, and therefore further treatment was needed (according to the method of treatment above). Repeated treatment resulted in lack of symptoms for the following 5-10 days, etc.

All patients described that the effect of the treatment they underwent remained unchanged over time, i.e. it did not seem to decrease when the treatment of the individual or the patient was repeated.

Comparative Treatment, One Patient with Rhinitis Medicamentosa

As a comparative experiment, one patient with rhinitis medicamentosa was treated with nose drops for common cold in one nostril, and with vibrational stimulation according to above (as for other patients with rhinitis medicamentosa) in the other nostril. At the time of treatment, this patient had been addicted to nose drops for more than ten years.

After treatment with nose drops in one nostril, a constant, even degree of decongestion was observed. After treatment with vibrational stimulation in the other nostril, the nerve function in the nostril returned to normal, i.e. a varying degree of congestion was observed day and night. Normally, the variations of the nasal congestion during day and night can be described as following a sinus curve in each nostril. The nasal congestion is initially non-existent in one nostril, and then increasing. The nasal congestion in the other nostril normally follows an inverted sinus curve when compared to the first nostril, which means that when one nostril is congested, the other nostril is open and vice versa.

Patient with Neuralgia (but Otherwise Healthy)

This patient had pain in the nose since more than 10 years. The patient has tried all types of pain-relieving treatment and/or medication available without any actual effect. Strong analgesics have resulted in a few hours of pain relief.

The diagnosis neuralgia was made after other possible causes of pain in the nose had been excluded.

The present pain-relieving treatment was discontinued. After treatment according to the above method of treatment (frequency 48 Hz, pressure 40-50 cm water (3.9-4.9 kPa)) for a time period of 7 minutes, the patient became free of pain and medication for 8 weeks, which corresponds to the follow-up time so far in this case.

Patients with Non-Allergic Inflammation in the Nasal Cavity

These patients have all been tested for allergy, but were found not to have any allergy that could be diagnosed. The patients used cortisone spray to the nose daily to alleviate congestion and/or increased secretion in the nose. The medication somewhat alleviated their symptoms.

The patients were treated according to the above method (frequency 48 Hz, pressure 40-50 cm water (3.9-4.9 kPa)) for a time period of 7 minutes in one nostril. The treatment was conducted one week after the medication with cortisone spray was discontinued entirely. The treated nasal cavity was experienced as more open (improvement in average from 6 to 3 on the VAS scale) and with less secretion (improvement in average from 5 to 3 on the VAS scale) than the untreated nostril (remained on VAS scale evaluation 6 and 5, respectively) during the week following the treatment.

Patients with Impaired Sense of Smell

These patients said themselves that they experienced an impaired sense of smell.

The patients experienced an improved sense of smell after treatment according to the above method (frequency 48 Hz, pressure 70 cm (6.9 kPa)) for a time period of 7 minutes.

Patients with Snoring that is Disturbing to Those Around them

The patients, which were considered to have a disturbing snoring by those around them, stopped snoring after treatment according to the above method, according to relatives.

In conclusion, the tests showed that the method for vibrational stimulation does not give rise to any "rebound" congestion, i.e. no so called rebound effect with increased congestion follows, not even after repeated treatment over time. This rebound effect occurs with most so called nose drops for common cold that are commercially available. The method of treatment can furthermore be used from the new-born period and during pregnancy without side effects.

Thus, a vibration device for use in body cavities that are difficult to reach for stimulation of sensitive body tissue in a patient has been provided. The device according to the invention is simple to use for a patient or another operator. The device is readily introducible through a narrow body opening and can be arranged in a second state, wherein the stimulation means is at least partly expanded for abutting against body tissue without pushing away the tissue.

Moreover, a method for stimulation of body tissue in a body cavity has been provided. The method promotes normalization of nerve function in peripheral sensory nerves and probably also in motory nerves. When treating a number of conditions in the nasal cavity, the method gives an effect when traditional treatment regimens lack effect. The method has no side effects and can suitably be used by patients of all ages. In addition, it is pain-free and quick, and often results in prolonged effect with alleviation of symptoms or removal of symptoms.

The invention claimed is:

1. A vibration device for stimulation of body tissue in a nasal cavity of a patient, comprising:

an expandable stimulation member;

an expansion member configured to expand the stimulation member from a first, unexpanded state to a second, expanded state, wherein the expansion member comprises at least one channel for supplying fluid to the stimulation member to achieve said expansion, and the stimulation member is arranged at least partly around the expansion member such that one end of the expansion member is located freely inside the stimulation member; and an externally arranged vibration source connected to the expansion member and configured to bring the stimulation member to vibrate at a frequency of 48-70 Hz, wherein the stimulation member is configured, in the first, unexpanded state to be capable of being introduced via a nasal opening into the nasal cavity, and in the second, expanded state to be expanded to a volume such that the stimulation member is capable of abutting against the tissue within the nasal cavity.

2. The vibration device according to claim 1, wherein the stimulation member in said second state is adapted to abut the body tissue with a pressure of 3.9-9.8 kPa (40-100 cm water).

3. The vibration device according to claim 2, wherein the stimulation member in said second state is adapted to abut the body tissue with a pressure of 3.9-7.8 kPa (40-80 cm water).

4. The vibration device according to claim 1, wherein the stimulation member is elastic.

5. The vibration device according to claim 1, wherein the stimulation member has a smooth outer surface.

6. The vibration device according to claim 1, wherein an outer surface of the stimulation member comprises a lubricant.

7. The vibration device according to claim 1, wherein the stimulation member is coated with a substance that is adapted to cause a chemical or biological activity locally in the nasal cavity or peripherally in the patient.

8. The vibration device according to claim 1, wherein the stimulation member is made of a plastic material.

9. The vibration device according to claim 1, wherein the stimulation member is made of a rubber material.

10. The vibration device according to claim 1, comprising an exchangeable hygienic protective cover, arranged to enclose the stimulation member.

11. The vibration device according to claim 1, wherein the vibration source is arranged to provide vibrations to the fluid.

12. The vibration device according to claim 1, further comprising a stabilizing section.

13. The vibration device according to claim 12, wherein, in the first state, the stimulation member is arranged around the stabilizing section.

14. The vibration device according to claim 1, wherein the vibration device is a tone generator.

15. The device according to claim 1, wherein said stimulation member has a lateral width in the range of 10 to 20 mm when in the second expanded state and the expansion member has a width in the range of 1 to 15 mm.

16. The device according to claim 1, wherein said stimulation member has a length in the range of 40 to 60 mm and the expansion member has a length in the range of 80-100 cm.

17. The device according to claim 1, wherein said stimulation member is flexible and not rigid and said expansion member is flexible so as to allow the device to access spaces in the nasal cavity that are difficult to access.

18. The device according to claim 1, wherein said stimulation member is, in its second state, configured to transfer vibrations to the body tissue in the nasal cavity by direct physical contact between the outer surface of the stimulation member and the tissue surface.

19. The device according to claim 1, wherein said one end of the expansion member being located freely inside the stimulation member has a length of maximally 4 cm.

20. The device according to claim 1, wherein the at least one channel in the expansion member is closed along an entire length thereof from the vibration source to the stimulation member.

21. A method for stimulation of body tissue in a nasal cavity of a patient, said method comprising the steps of:

providing a vibration device comprising an expandable stimulation member and an expansion member configured to expand the stimulation member, wherein the stimulation member is configured to be introduced via a nasal opening into the nasal cavity;

arranging the stimulation member at least partly around the expansion member such that one end of the expansion member is located freely inside the stimulation member;

introducing the stimulation member via the nasal opening into the nasal cavity, while the stimulation member is in a first, unexpanded state;

expanding the stimulation member to a second, expanded state of the vibration device such that the stimulation member is adapted to abut against the tissue within the nasal cavity; and bringing the stimulation member to vibrate in said second state at a frequency of 48-70 Hz.

22. The method according to claim 21, wherein the stimulation proceeds for a time period of from 1 second to 30 minutes.

23. The method according to claim 22, wherein the stimulation proceeds for a time period of from 15 seconds to 7 minutes.

24. The method according to claim 21, wherein the stimulation is conducted at an amplitude of between 0.05 mm and 20 mm.

25. The method according to claim 24, wherein the stimulation is conducted at an amplitude of between 0.3 mm and 5 mm.

26. The method according to claim 21, wherein the stimulation in the nasal cavity is used for treatment of patients suffering from a condition selected from common cold, allergic rhinitis, chronic or non-chronic non-allergic rhinitis, rhinitis medicamentosa, disturbance of the sense of smell, risk of relapse following polyps treatment, and snoring.

27. The method according to claim 21, wherein the stimulation member in said second state is adapted to abut the body tissue with a pressure of 3.9-9.8 kPa (40-100 cm water).

28. The method according to claim 21, wherein the stimulation member in said second state is adapted to abut the body tissue with a pressure of 3.9-7.8 kPa (40-80 cm water).

29. The method according to claim 21, wherein said step of bringing the stimulation member to vibrate in said second state is performed with a tone generator.

30. The method according to claim 21, wherein the expansion member is closed along an entire length thereof from a vibration source to the stimulation member.

31. The method according to claim 21, wherein said stimulation member has a lateral width in the range of 10 to 20 mm when in the second expanded state and the expansion member has a width in the range of 1 to 15 mm.

32. The method according to claim 21, wherein said stimulation member has a length in the range of 40 to 60 mm and the expansion member has a length in the range of 80-100 cm.

33. The method according to claim 21, wherein said stimulation member is flexible and not rigid and said expansion member is flexible so as to allow the device to access spaces in the nasal cavity that are difficult to access.

34. The method according to claim 21, wherein said stimulation member is, in its second state, configured to transfer vibrations to the body tissue in the nasal cavity by direct physical contact between the outer surface of the stimulation member and the tissue surface.

35. The method according to claim 21, wherein said one end of the expansion member being located freely inside the stimulation member has a length of maximally 4 cm.

36. A vibration device for stimulation of body tissue in a nasal cavity of a patient for the treatment of rhinitis, comprising:

an expandable stimulation member;

an expansion member connected to the expandable stimulation member and configured to expand the stimulation member from a first, unexpanded state to a second, expanded state, wherein the expansion member comprises a channel for supplying fluid to the stimulation member to achieve said expansion, and the stimulation member is arranged at least partly around the expansion member such that one end of the expansion member is located freely inside the stimulation member; and an externally arranged vibration source connected to the channel of the expansion member and configured to bring the stimulation member to vibrate at a frequency of 48-70 Hz, wherein the stimulation member is configured, in the first, unexpanded state to be capable of being introduced via a nasal opening into the nasal cavity, and in the second, expanded state to be expanded to a volume such that the stimulation member is capable of abutting against the tissue within the nasal cavity, and wherein the channel of the expansion member is closed along an entire length thereof from the vibration source to the expandable stimulation member during operation of the vibration device.

* * * * *